US012590263B2

(12) United States Patent
Mizutani et al.

(10) Patent No.: US 12,590,263 B2
(45) Date of Patent: Mar. 31, 2026

(54) LUBRICANT ADDITIVE, LUBRICANT COMPOSITION, AND WORKING FLUID COMPOSITION

(71) Applicant: ENEOS Corporation, Tokyo (JP)

(72) Inventors: Yuya Mizutani, Tokyo (JP); Hidetoshi Ogata, Tokyo (JP); Tomohiro Takaki, Tokyo (JP); Takeshi Okido, Tokyo (JP)

(73) Assignee: ENEOS CORPORATION, Tokyo (JP)

( * ) Notice: Subject to any disclaimer, the term of this patent is extended or adjusted under 35 U.S.C. 154(b) by 0 days.

(21) Appl. No.: 18/841,790

(22) PCT Filed: Feb. 20, 2023

(86) PCT No.: PCT/JP2023/006005

§ 371 (c)(1),
(2) Date: Aug. 27, 2024

(87) PCT Pub. No.: WO2023/167036

PCT Pub. Date: Sep. 7, 2023

(65) Prior Publication Data

US 2025/0163341 A1 May 22, 2025

(30) Foreign Application Priority Data

Mar. 2, 2022 (JP) ..... 2022-031514

(51) Int. Cl.

| | |
|---|---|
| ***C10M 137/04*** | (2006.01) |
| ***C10M 131/02*** | (2006.01) |
| ***C10M 169/04*** | (2006.01) |
| *C10N 40/30* | (2006.01) |

(52) U.S. Cl.

CPC ..... *C10M 137/04* (2013.01); *C10M 131/02* (2013.01); *C10M 169/04* (2013.01); *C10M 2211/02* (2013.01); *C10M 2223/04* (2013.01); *C10N 2040/30* (2013.01)

(58) Field of Classification Search

CPC ..... C10M 137/04; C10M 131/02; C10M 169/04; C10M 2211/02; C10M 2223/04; C10N 2040/30

See application file for complete search history.

(56) References Cited

U.S. PATENT DOCUMENTS

| | | | |
|---|---|---|---|
| 6,242,631 | B1 | 6/2001 | Hombek et al. |
| 2012/0101015 | A1 | 4/2012 | Frapin et al. |
| 2016/0122679 | A1 | 5/2016 | Takata et al. |
| 2019/0128249 | A1 | 5/2019 | Oota et al. |

FOREIGN PATENT DOCUMENTS

| | | | | |
|---|---|---|---|---|
| CN | 102482610 | A * | 5/2012 | ..... C10M 169/04 |
| JP | 54-75100 | A | 6/1979 | |
| JP | 2002-97486 | A | 4/2002 | |
| JP | 2002-526571 | A | 8/2002 | |
| JP | 2013-23580 | A | 2/2013 | |
| JP | 2013-108033 | A | 6/2013 | |
| WO | 00/17210 | A1 | 3/2000 | |
| WO | 2014/196467 | A1 | 12/2014 | |
| WO | 2016/063833 | A1 | 4/2016 | |
| WO | 2018/083981 | A1 | 5/2018 | |

OTHER PUBLICATIONS

International Search Report that issued in International Patent Application No. PCT/JP2023/006005, dated May 9, 2023, along with an English translation thereof.

International Preliminary Report on Patentability for International Patent Application No. PCT/JP2023/006005, mailed Sep. 12, 2024, along with an English translation thereof.

De Nola G. et al., "Determination of ortho-cresyl phosphate isomers of tricresyl phosphate used in aircraft turbine engine oils by gas chromatography and mass spectrometry", Journal of Chromatography A, Elsevier, Amsterdam, NL, vol. 1200, No. 2, Jul. 2008, p. 211-p. 216, XP022808383.

Extended European Search Report that issued in corresponding European Patent Application No. 23763295.5, dated May 12, 2025.

* cited by examiner

*Primary Examiner* — Taiwo Oladapo

(74) *Attorney, Agent, or Firm* — Greenblum & Bernstein, P.L.C.

(57) ABSTRACT

An additive for a lubricating oil containing a phosphorus compound P represented by the following formula (1):

(1)

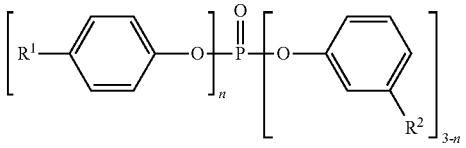

wherein $R^1$ and $R^2$ each independently represent an alkyl group having 1 to 3 carbon atoms, and n represents an integer of 0 to 3, wherein the phosphorus compound P contains a phosphorus compound P0 wherein n is 0, a phosphorus compound P1 wherein n is 1, a phosphorus compound P2 where n is 2, and a phosphorus compound P3 wherein n is 3, and a total proportion of the phosphorus compound P0 and the phosphorus 10 compound P1 in the phosphorus compound P is 60% by mole or more.

5 Claims, No Drawings

LUBRICANT ADDITIVE, LUBRICANT COMPOSITION, AND WORKING FLUID COMPOSITION

TECHNICAL FIELD

The present disclosure relates to an additive for a lubricating oil, a lubricating oil composition, and a working fluid composition.

BACKGROUND ART

Conventionally, lubricating oil compositions are used in mechanical devices to improve lubricity between components.

Lubricating oil compositions are applied to lubricated parts, forming a lubricating film on the surface of the lubricated parts to ensure their lubricity. Generally, the lubricating oil compositions contain additives (additives for a lubricating oil) selected according to desired properties in addition to a lubricating base oil. For example, anti-wear agents are used as additives for a lubricating oil to improve lubricity (anti-wear property). Various phosphorus compounds are known as anti-wear agents (see, for example, Patent Documents 1 to 3).

CITATION LIST

Patent Literature

[Patent Document 1] Japanese Unexamined Patent Publication No. 2002-097486

[Patent Document 2] Japanese Unexamined Patent Publication No. 2013-023580

[Patent Document 3] Japanese Unexamined Patent Publication No. 2013-108033

SUMMARY OF INVENTION

Technical Problem

Incidentally, since moisture and air may be mixed into the lubricating oil composition during its use, it is desirable that the additives contained in the lubricating oil composition have high stability against moisture and air. For example, orthophosphoric acid esters, used as anti-wear agents, may generate acidic degradation components through hydrolysis when moisture is mixed in. If these degradation components are excessively generated, acid value of the lubricating oil composition tends to excessively increase due to the degradation of the lubricating base oil and the consumption of additives, which may result in problems such as the corrosion of metal components, including the lubricated parts that come into contact with the lubricating oil composition. Therefore, one aspect of the present invention aims to provide an additive for a lubricating oil that has excellent hydrolytic stability.

Solution to Problem

The inventors of the present invention have found that the chemical structure of a tri(alkylphenyl) phosphate, which is one of the orthophosphoric acid esters, affects the hydrolytic stability. More specifically, in one aspect, it has been found that the hydrolytic stability varies depending on the substitution position of the alkyl group on the phenyl ring of the tri(alkylphenyl) phosphate, and that excellent hydrolytic stability can be obtained by using a mixture of the tri (alkylphenyl) phosphates having different substitution positions from each other at a specific proportion, as compared with the case where the specific proportion is not satisfied.

One aspect of the present invention is an additive for a lubricating oil containing a phosphorus compound P represented by the following formula (1):

[Chem. 1]

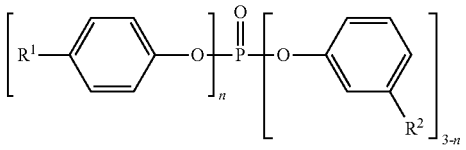

(1)

wherein $R^1$ and $R^2$ each independently represent an alkyl group having 1 to 3 carbon atoms, and n represents an integer of 0 to 3, wherein the phosphorus compound P contains a phosphorus compound P0 wherein n is 0, a phosphorus compound P1 wherein n is 1, a phosphorus compound P2 where n is 2, and a phosphorus compound P3 wherein n is 3, and a total proportion of the phosphorus compound P0 and the phosphorus compound P1 in the phosphorus compound P is 60% by mole or more.

Another aspect of the present invention is a lubricating oil composition A lubricating oil composition containing: a lubricating base oil; and a phosphorus compound P represented by the following formula (1):

[Chem. 2]

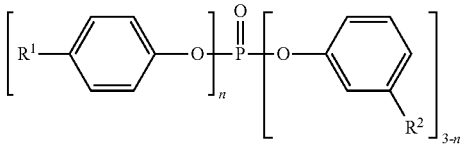

(1)

wherein $R^1$ and $R^2$ each independently represent an alkyl group having 1 to 3 carbon atoms, and n represents an integer of 0 to 3, wherein the phosphorus compound P comprises a phosphorus compound P0 wherein n is 0, a phosphorus compound P1 wherein n is 1, a phosphorus compound P2 where n is 2, and a phosphorus compound P3 wherein n is 3, and a total proportion of the phosphorus compound P0 and the phosphorus compound P1 in the phosphorus compound P is 60% by mole or more.

In each of the above aspects, a total proportion of the phosphorus compound P1 and the phosphorus compound P2 in the phosphorus compound P may be 50% by mole or more. A total proportion of the phosphorus compound P0, the phosphorus compound P1, and the phosphorus compound P2 in the phosphorus compound P may be 92% by mole or more, and a total proportion of the phosphorus compound P1, the phosphorus compound P2, and the phosphorus compound P3 in the phosphorus compound P may be 82% by mole or less.

The above lubricating oil composition may be used together with a refrigerant.

Another aspect of the present invention is a working fluid composition containing the above lubricating oil composition and a refrigerant. The refrigerant may be represented by the following formula (X):

$$C_aF_bR_c \quad (X)$$

wherein R represents Cl, I, or H, a represents an integer of 1 to 6, b represents an integer of 0 to 12, and c represents an integer of 0 to 11.

Advantageous Effects of Invention

According to one aspect of the present invention, it is possible to provide an additive for a lubricating oil that has excellent hydrolytic stability. According to another aspect of the present invention, it is possible to provide a lubricating oil composition that has excellent stability (particularly stability in the presence of a refrigerant).

DESCRIPTION OF EMBODIMENTS

Hereinafter, embodiments of the present invention will be described in detail. One embodiment of the present invention is an additive for a lubricating oil containing a phosphorus compound P represented by the following formula (1):

[Chem. 3]

(1)

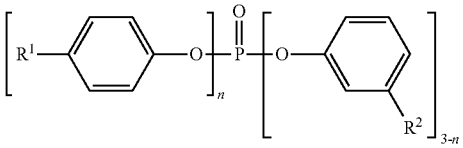

wherein $R^1$ and $R^2$ each independently represent an alkyl group having 1 to 3 carbon atoms, and n represents an integer of 0 to 3.

The phosphorus compound P contains a phosphorus compound P0 wherein n is 0 in the formula (1), a phosphorus compound P1 wherein n is 1 in the formula (1), a phosphorus compound P2 wherein n is 2 in the formula (1), and a phosphorus compound P3 wherein n is 3 in the formula (1). That is, the phosphorus compound P contains the phosphorus compound P0 represented by the following formula (10), the phosphorus compound P1 represented by the following formula (11), the phosphorus compound P2 represented by the following formula (12), and the phosphorus compound P3 represented by the following formula (13):

[Chem. 4]

(10)

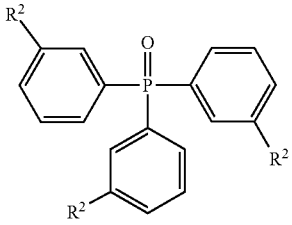

(11)

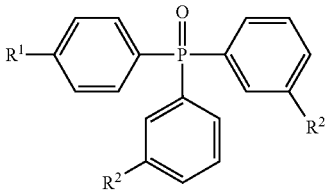

-continued (12)

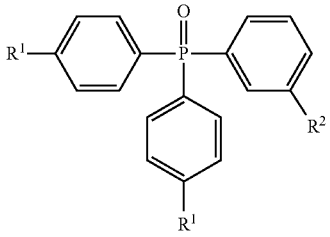

(13)

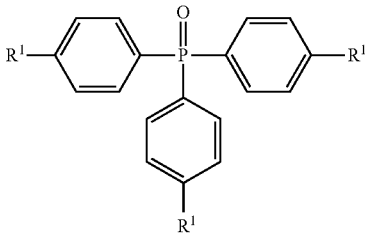

In the formulas (10) to (13), $R^1$ and $R^2$ are synonymous with $R^1$ and $R^2$ in the formula (1). $R^1$ and $R^2$ in the formulas (1) and (10) to (13) each independently represent a methyl group, an ethyl group, or a linear or branched propyl group, preferably a methyl group.

In one embodiment, the lubricating oil additive contains a phosphorus compound P that contains all of the phosphorus compound P0, phosphorus compound P1, phosphorus compound P2, and phosphorus compound P3, thereby improving the stability (particularly the stability in the presence of a refrigerant) of the lubricating oil composition compared to a lubricating oil additive containing only the phosphorus compound P0 (tri(m-alkylphenyl) phosphate) or the phosphorus compound P3 (tri(p-alkylphenyl) phosphate). For example, when this lubricating oil additive is used in a lubricating oil composition together with additional additives such as antioxidants and acid scavengers, it can suppress the consumption of these additional additives and increase their residual rate compared to a lubricating oil additive containing only the phosphorus compound P0 or phosphorus compound P3, thereby maintaining the stability of the lubricating oil composition (and further the stability of the refrigerant) for a longer period.

In another embodiment, the hydrolytic stability of the lubricating oil additive can be improved by adjusting the proportions of the phosphorus compound P0, phosphorus compound P1, phosphorus compound P2, and phosphorus compound P3 in the phosphorus compound P to the ranges described below. The composition of the phosphorus compound P (the proportions of the phosphorus compound P0, phosphorus compound P1, phosphorus compound P2, and phosphorus compound P3) described below is measured by the method described in the examples.

The total proportion of the phosphorus compound P0 and phosphorus compound P1 (P0+P1) in the phosphorus compound P is 60% by mole or more from the viewpoint of excellent hydrolytic stability. From the viewpoint of further improving the hydrolytic stability and the stability of the lubricating oil composition, the proportion (P0+P1) may be preferably 66% by mole or more, 70% by mole or more, or 72% by mole or more, and preferably 90% by mole or less, 78% by mole or less, or 76% by mole or less.

The total proportion of the phosphorus compound P2 and phosphorus compound P3 (P2+P3) in the phosphorus compound P is 40% by mole or less from the viewpoint of excellent hydrolytic stability. From the viewpoint of further improving the hydrolytic stability and the stability of the lubricating oil composition, the proportion (P2+P3) may be preferably 34% by mole or less, 30% by mole or less, or 28% by mole or less, and preferably 10% by mole or more, 20% by mole or more, or 24% by mole or more.

The total proportion of the phosphorus compound P1 and phosphorus compound P2 (P1+P2) in the phosphorus compound P may be preferably 50% by mole or more, 60% by mole or more, 63% by mole or more, or 65% by mole or more, and 73% by mole or less, 70% by mole or less, 69% by mole or less, or 68% by mole or less, from the viewpoint of further improving the hydrolytic stability and the stability of the lubricating oil composition.

The total proportion of the phosphorus compound P0, phosphorus compound P1, and phosphorus compound P2 (P0+P1+P2) in the phosphorus compound P may be preferably 92% by mole or more, 94% by mole or more, or 95% by mole or more, and 99% by mole or less, 98% by mole or less, or 97% by mole or less, from the viewpoint of further improving the hydrolytic stability and the stability of the lubricating oil composition.

The total proportion of the phosphorus compound P1, phosphorus compound P2, and phosphorus compound P3 (P1+P2+P3) in the phosphorus compound P may preferably 82% by mole or less, 80% by mole or less, 77% by mole or less, or 75% by mole or less, and 50% by mole or more, 55% by mole or more, 60% by mole or more, 65% by mole or more, or 68% by mole or more, from the viewpoint of further improving the hydrolytic stability and the stability of the lubricating oil composition.

The proportion of the phosphorus compound P0 in the phosphorus compound P may preferably 16% by mole or more, 18% by mole or more, 20% by mole or more, 24% by mole or more, or 28% by mole or more, and 50% by mole or less, 40% by mole or less, 35% by mole or less, or 32% by mole or less, from the viewpoint of further improving the hydrolytic stability and the stability of the lubricating oil composition.

The proportion of the phosphorus compound P1 in the phosphorus compound P may be preferably 40% by mole or more, 41% by mole or more, 42% by mole or more, or 43% by mole or more, and 60% by mole or less, 55% by mole or less, 50% by mole or less, or 46% by mole or less, from the viewpoint of further improving the hydrolytic stability and the stability of the lubricating oil composition.

The proportion of the phosphorus compound P2 in the phosphorus compound P may be preferably 10% by mole or more, 15% by mole or more, or 19% by mole or more, and 34% by mole or less, 30% by mole or less, 27% by mole or less, or 24% by mole or less, from the viewpoint of further improving the hydrolytic stability and the stability of the lubricating oil composition.

The proportion of the phosphorus compound P3 in the phosphorus compound P may be preferably 1% by mole or more, 2% by mole or more, or 3% by mole or more, and 9% by mole or less, 8% by mole or less, 6% by mole or less, or 5% by mole or less, from the viewpoint of further improving the hydrolytic stability and the stability of the lubricating oil composition, and from the viewpoint of better stability at a low temperature.

The molar ratio of the proportion of the phosphorus compound P0 to the proportion of the phosphorus compound P3 (P0/P3) in the phosphorus compound P may be preferably 2 or more, 4 or more, 5 or more, or 6 or more, and 50 or less, 30 or less, 20 or less, or 10 or less, from the viewpoint of further improving the stability of the lubricating oil composition, particularly the stability at a low temperature.

The molar ratio of the proportion of the phosphorus compound P1 to the proportion of the phosphorus compound P2 (P1/P2) in the phosphorus compound P may be preferably 1.2 or more, 1.5 or more, or 1.8 or more, and 5 or less, 4 or less, 3 or less, or 2.3 or less, from the viewpoint of further improving the hydrolytic stability and the stability of the lubricating oil composition.

The molar ratio of the proportion of the phosphorus compound P1 to the proportion of the phosphorus compound P0 (P1/P0) in the phosphorus compound P may be preferably 0.1 or more, 1 or more, or 1.4 or more, and 2.4 or less, 2 or less, or 1.7 or less, from the viewpoint of further improving the hydrolytic stability and the stability of the lubricating oil composition.

The molar ratio of the proportion of the phosphorus compound P2 to the proportion of the phosphorus compound P0 (P2/P0) in the phosphorus compound P may be preferably 0.1 or more, 0.5 or more, or 0.7 or more, and 2 or less, 1.2 or less, or 1 or less, from the viewpoint of further improving the hydrolytic stability and the stability of the lubricating oil composition.

The molar ratio of the total proportion of the phosphorus compound P1 and phosphorus compound P2 to the proportion of the phosphorus compound P0 ((P1+P2)/P0) in the phosphorus compound P may be preferably 1 or more, 1.5 or more, or 2 or more, and 4 or less, 3 or less, or 2.7 or less, from the viewpoint of further improving the hydrolytic stability and the stability of the lubricating oil composition.

The molar ratio of the proportion of the phosphorus compound P3 to the proportion of the phosphorus compound P0 (P3/P0) in the phosphorus compound P may be preferably 0.02 or more, 0.03 or more, 0.05 or more, or 0.1 or more, and 0.5 or less, 0.25 or less, 0.2 or less, or 0.17 or less, from the viewpoint of further improving the hydrolytic stability and the stability of the lubricating oil composition.

The molar ratio of the proportion of the phosphorus compound P1 to the proportion of the phosphorus compound P3 (P1/P3) in the phosphorus compound P may be preferably 5 or more, 7.5 or more, or 10 or more, and 20 or less, 17 or less, or 14 or less, from the viewpoint of further improving the hydrolytic stability and the stability of the lubricating oil composition.

The molar ratio of the proportion of the phosphorus compound P2 to the proportion of the phosphorus compound P3 (P2/P3) in the phosphorus compound P may be preferably 4 or more, 5 or more, or 5.5 or more, and 10 or less, 8 or less, or 7 or less, from the viewpoint of further improving the hydrolytic stability and the stability of the lubricating oil composition.

The molar ratio of the total proportion of the phosphorus compound P1 and phosphorus compound P2 to the proportion of the phosphorus compound P3 ((P1+P2)/P3) in the phosphorus compound P may be preferably 8 or more, 12 or more, 15 or more, or 16 or more, and 50 or less, 30 or less, 25 or less, or 20 or less, from the viewpoint of further improving the hydrolytic stability and the stability of the lubricating oil composition.

The molar ratio of the total proportion of the phosphorus compound P0 and phosphorus compound P1 to the total proportion of the phosphorus compound P2 and phosphorus compound P3 ((P0+P1)/(P2+P3)) in the phosphorus compound P may be preferably 1.5 or more, 2 or more, 2.2 or more, or 2.4 or more, and 5 or less, 4 or less, 3.5 or less, or 3.2 or less, from the viewpoint of further improving the hydrolytic stability and the stability of the lubricating oil composition.

Each of the proportions of the phosphorus compound P0, phosphorus compound P1, phosphorus compound P2, and phosphorus compound P3 in the phosphorus compound P can be adjusted by the following method.

Each of 3-alkylphenol such as m-cresol and 4-alkylphenol such as p-cresol (wherein the alkyl group in these alkylphenols has 1 to 3 carbon atoms, the same applies hereinafter) is prepared. Each of 3-alkylphenol and 4-alkylphenol can be synthesized by a known method or purchased commercially. By reacting a mixture of 3-alkylphenol and 4-alkylphenol in a certain proportion with phosphoric acid or phosphorus trichloride, a mixture of the phosphorus compounds P0, phosphorus compound P1, phosphorus compound P2, and phosphorus compound P3 can be obtained. If the obtained mixture of phosphorus compounds meets the above-mentioned proportions, this mixture can be used as the phosphorus compound P as it is. Alternatively, the obtained mixture of phosphorus compounds can be purified and separated based on the differences in boiling points or melting points of the phosphorus compounds P0 to P3, and then the phosphorus compounds P0 to P3 can be mixed again in the desired proportions to prepare the phosphorus compound P with the desired proportions.

The proportion of the p-alkylphenyl group represented by the following formula (2-1):

[Chem. 5]

(2-1)

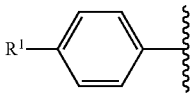

wherein $R^1$ is synonymous with $R^1$ in the formula (1), based on the total amount of alkylphenyl groups in the phosphorus compound P, may be preferably 55% by mole or more, or 57% by mole or more, and 80% by mole or less, 70% by mole or less, 65% by mole or less, or 63% by mole or less, from the viewpoint of further improving the hydrolytic stability and the stability of the lubricating oil composition. The proportions of the m-alkylphenyl group, p-alkylphenyl group, and o-alkylphenyl group are measured by the method described in the examples.

The proportion of the m-alkylphenyl group represented by the following formula (2-2):

[Chem. 6]

(2-2)

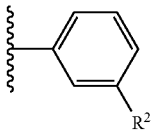

wherein $R^2$ is synonymous with $R^2$ in the formula (1), based on the total amount of alkylphenyl groups in the phosphorus compound P, may be preferably 20% by mole or more, 30% by mole or more, 35% by mole or more, or 37% by mole or more, and 45% by mole or less, or 43% by mole or less, from the viewpoint of further improving the hydrolytic stability and the stability of the lubricating oil composition.

The molar ratio of the proportion of the m-alkylphenyl group to the proportion of the p-alkylphenyl group ((m-)/(p-)) in the phosphorus compound P may be preferably 1.3 or more, and 3 or less, 2.5 or less, 2.2 or less, or 1.8 or less, from the viewpoint of further improving the hydrolytic stability and the stability of the lubricating oil composition.

The proportion of the o-alkylphenyl group as an impurity in the phosphorus compound P is preferably as low as possible, and may be preferably 1% by mole or less, 0.5% by mole or less, or 0.1% by mole or less, based on the total amount of alkylphenyl groups in the phosphorus compound P.

In one embodiment, impurities (for example, phosphorus compounds having the o-alkylphenyl group, phosphorus compounds having phenyl groups, phosphorus compounds having dialkylphenyl groups, and other phosphorus compounds other than the phosphorus compound P) may inevitably be mixed into the phosphorus compound P during the manufacturing process. If necessary, it is desirable to remove some or all of these impurities by purification. The concentration of these impurities in the phosphorus compound P may be preferably 3% by mole or less, 2% by mole or less, 1% by mole or less, or 0.1% by mole or less, based on the total amount of the phosphorus compound P and the impurities. Conversely, the purity of the phosphorus compound P containing these impurities may be preferably 97% by mole or more, 98% by mole or more, 99% by mole or more, or 99.9% by mole or more. The impurities referred to here do not include phosphorus compounds that cannot be generated during the manufacturing process or phosphorus compounds that are intentionally added afterward. The concentration of impurities and the purity of the phosphorus compound P can be confirmed by a $^{31}$P-NMR analysis.

The chlorine content in the phosphorus compound P (which may inevitably remain during the manufacturing process) may be preferably 300 ppm by mass or less, 150 ppm by mass or less, 100 ppm by mass or less, 50 ppm by mass or less, 30 ppm by mass or less, or 10 ppm by mass or less, from the viewpoint of further improving the hydrolytic stability and the stability of the lubricating oil composition. The chlorine content in the present specification refers to the chlorine content measured in accordance with JPI-5S-64-2002 (2017 supplement) "Petroleum Products—Test Method for Chlorine Content—Micro Coulometric Titration Method."

The acid value of the phosphorus compound P may be 0.5 mgKOH/g or less, and preferably 0.1 mgKOH/g or less, 0.05 mgKOH/g or less, or 0.03 mgKOH/g or less, from the viewpoint of better stability. The acid value in the present specification refers to the acid value measured in accordance with JIS C2101:1999.

The kinematic viscosity at 40° C. of the phosphorus compound P may be 20 $mm^2/s$ or higher and preferably 21 $mm^2/s$ or higher, and may be 25 $mm^2/s$ or lower and preferably 23 $mm^2/s$ or lower. The kinematic viscosity in the present specification refers to the kinematic viscosity measured in accordance with JIS K2283:2000.

The flash point (COC) of the phosphorus compound P may be 240° C. or higher, and preferably 250° C. or higher, 260° C. or higher, or 270° C. or higher from the viewpoint of classifying it not as a hazardous material under the Fire Service Act, allowing it to be handled as a designated combustible (flammable liquid) and increasing a flash point of the lubricating oil composition, and may be 300° C. or lower or 280° C. or lower. The flash point (COC) in the present specification refers to the flash point measured in accordance with the Cleveland Open Cup method of JIS K2265-4:2007.

Another embodiment of the present invention is a lubricating oil composition containing a lubricating base oil and the phosphorus compound P represented by the above formula (1).

In one embodiment, the stability (particularly the stability in the presence of a refrigerant) of the lubricating oil composition can be improved by the phosphorus compound P that contains all of the phosphorus compound P0, phosphorus compound P1, phosphorus compound P2, and phosphorus compound P3, compared to using only the phosphorus compound P0 or phosphorus compound P3. For example, when additional additives such as antioxidants and acid scavengers are used together with the phosphorus compound P in the lubricating oil composition, the phosphorus compound P can suppress the consumption of these additional additives and increase their residual rate compared to using only the phosphorus compound P0 or phosphorus compound P3, thereby maintaining the stability of the lubricating oil composition (and further the stability of the refrigerant) for a longer period.

In another embodiment, the hydrolytic stability of the phosphorus compound P can also be improved by adjusting the proportions of the phosphorus compound P0, phosphorus compound P1, phosphorus compound P2, and phosphorus compound P3 in the phosphorus compound P to the ranges described above.

The lubricating base oil is at least one selected from the group consisting of an oxygen-containing oil and a hydrocarbon oil. Examples of the oxygen-containing oil include an ester and an ether. Examples of the hydrocarbon oil include a mineral oil (a naphthenic mineral oil, a paraffinic mineral oil, etc.), an alkylbenzene, an alkylnaphthalene, a poly-α-olefin, a polybutene, and an ethylene-α-olefin copolymers.

In one embodiment, the lubricating base oil is at least one selected from the group consisting of an ester and an ether, and may be at least one selected from the group consisting of a polyol ester, a complex ester, a polyalkylene glycol, and a polyvinyl ether.

Examples of the polyol ester include an ester of a polyhydric alcohol and a fatty acid. The polyhydric alcohol may be a polyhydric alcohol having 2 to 6 hydroxyl groups. The number of carbon atoms of the polyhydric alcohol may be 4 to 12, or 5 to 10. Examples of the polyhydric alcohol include neopentyl glycol, trimethylol ethane, trimethylol propane, trimethylol butane, di-(trimethylol propane), tri-(trimethylol propane), pentaerythritol, and dipentaerythritol. The polyhydric alcohol may be preferably pentaerythritol, dipentaerythritol, or a mixture thereof.

The fatty acid may be linear or branched. The fatty acid may be a saturated fatty acid. The number of carbon atoms of the fatty acid may be 4 to 20, 4 to 18, 4 to 9, or 5 to 9. Examples of the fatty acid include a linear fatty acid having 4 to 20 carbon atoms such as butanoic acid, pentanoic acid, heptanoic acid, octanoic acid, nonanoic acid, decanoic acid, dodecanoic acid, and octadecanoic acid, and a branched fatty acid having 4 to 20 carbon atoms such as 2-methylpropanoic acid, 2-methylbutanoic acid, 2-methylpentanoic acid, 2-methylhexanoic acid, 2-ethylpentanoic acid, 2-methylheptanoic acid, 2-ethylhexanoic acid, 3,5,5-trimethylhexanoic acid, and 2-ethylhexadecanoic acid.

Examples of the complex ester include an ester synthesized from at least one polyhydric alcohol, at least one polybasic acid, and at least one selected from a monohydric alcohol and a monocarboxylic fatty acid.

Examples of the polyhydric alcohol include neopentyl glycol, trimethylol propane, and pentaerythritol. In addition to these polyhydric alcohols, the polyhydric alcohol may further contain a dihydric alcohol having 2 to 10 carbon atoms other than neopentyl glycol. Examples of the dihydric alcohol having 2 to 10 carbon atoms other than neopentyl glycol include ethylene glycol, propanediol, butanediol, pentanediol, hexanediol, 2-methyl-1,3-propanediol, 3-methyl-1,5-pentanediol, and 2,2-diethyl-1,3-pentanediol.

The polybasic acid may be a polybasic acid having 6 to 12 carbon atoms. Examples of the polybasic acid include adipic acid, pimelic acid, suberic acid, azelaic acid, sebacic acid, phthalic acid, and trimellitic acid.

The monohydric alcohol may be a monohydric alcohol having 4 to 18 carbon atoms. Examples of the monohydric alcohol include butanol, pentanol, hexanol, heptanol, octanol, nonanol, decanol, dodecanol, and oleyl alcohol.

The monocarboxylic fatty acid may be a monocarboxylic fatty acid having 2 to 12 carbon atoms. Examples of the monocarboxylic fatty acid include acetic acid, propanoic acid, butanoic acid, pentanoic acid, hexanoic acid, heptanoic acid, octanoic acid, nonanoic acid, decanoic acid, and dodecanoic acid.

Examples of the polyalkylene glycol include a polyethylene glycol, a polypropylene glycol, and a polybutylene glycol. The polyalkylene glycol may be a polyalkylene glycol having copolymer chains of two or more selected from oxyethylene, oxypropylene, and oxybutylene. The terminal ends of these polyalkylene glycols may be alkylated or acylated.

Examples of the polyvinyl ether include a homopolymer of an alkyl vinyl ether having 1 to 20 carbon atoms and a copolymer of two or more alkyl vinyl ethers having 1 to 20 carbon atoms. In one embodiment, the polyvinyl ether may be a copolymer of an alkyl vinyl ether having an alkyl group with 1 to 3 carbon atoms (preferably an ethyl group) and an alkyl vinyl ether having an alkyl group with 3 to 8 carbon atoms (preferably an isobutyl group).

The content of the lubricating base oil may be preferably 50% by mass or more, 60% by mass or more, 70% by mass or more, 80% by mass or more, or 90% by mass or more, and may be 99% by mass or less, based on the total amount of the lubricating oil composition.

The details of the phosphorus compound P are as described above for the phosphorus compound P in the additive for a lubricating oil. The content of the phosphorus compound P may be 0.01% by mass or more, 0.1% by mass or more, or 0.5% by mass or more, and may be 5% by mass or less, 3% by mass or less, or 1.5% by mass or less, based on the total amount of the lubricating oil composition.

The lubricating oil composition may further contain an additional additive in addition to the phosphorus compound P. Examples of the additional additive include at least one selected from the group consisting of an antioxidant, an acid scavenger, an anti-wear agent (extreme pressure agent) other than the phosphorus compound P, a defoamer, a metal deactivator, a viscosity index improver, a pour point depressant, and a detergents-dispersant. The total amount of the additional additive(s) may be 0.01% by mass or more and 5% by mass or less, based on the total amount of the lubricating oil composition.

The lubricating oil composition preferably further contains an antioxidant. Examples of the antioxidant include a phenolic antioxidant. Examples of the phenolic antioxidant include 2,6-di-tert-butyl-p-cresol (DBPC), 2,6-di-tert-butyl-phenol, and 4,4'-methylenebis(2,6-di-tert-butyl-phenol). The content of the antioxidant may be 0.01% by mass or more or 0.1% by mass or more, and 5% by mass or less, 3% by mass or less, or 1% by mass or less, based on the total amount of the lubricating oil composition.

The lubricating oil composition preferably further contains an anti-wear agent (extreme pressure agent) other than the phosphorus compound P. Examples of the anti-wear agent (extreme pressure agent) include a phosphorus-based anti-wear agent (extreme pressure agent) other than the phosphorus compound P, a sulfur-based anti-wear agent (extreme pressure agents), and a phosphorus-sulfur-based anti-wear agent (extreme pressure agent). The phosphorus-based anti-wear agent (extreme pressure agent) has a phosphorus atom and has no sulfur atom. The sulfur-based anti-wear agent (extreme pressure agent) has a sulfur atom and has no phosphorus atom. The phosphorus-sulfur-based anti-wear agent (extreme pressure agent) has both phosphorus and sulfur atoms. The content of the anti-wear agent (extreme pressure agent) other than the phosphorus compound P may be 0.01% by mass or more or 0.1% by mass or more, and 5% by mass or less, 3% by mass or less, or 1% by mass or less, based on the total amount of the lubricating oil composition.

The lubricating oil composition preferably further contains an acid scavenger. Examples of the acid scavenger include an epoxy-based acid scavenger. Examples of the epoxy-based acid scavenger include a glycidyl ether-based acid scavenger, a glycidyl ester-based acid scavenger, and an alicyclic epoxy-based acid scavenger. The content of the acid scavenger may be 0.01% by mass or more or 0.1% by mass or more, and 5% by mass or less, 3% by mass or less, or 1% by mass or less, based on the total amount of the lubricating oil composition.

The kinematic viscosity at 40° C. of the lubricating oil composition may be, for example, 3 $mm^2/s$ or higher, 10 $mm^2/s$ or higher, or 20 $mm^2/s$ or higher, and 500 $mm^2/s$ or lower or 300 $mm^2/s$ or lower. The kinematic viscosity at 100° C. of the lubricating oil composition may be, for example, 1 $mm^2/s$ or higher or 2 $mm^2/s$ or higher, and 100 $mm^2/s$ or lower or 50 $mm^2/s$ or lower.

The viscosity index of the lubricating oil composition may be, for example, 10 or more, 50 or more, or 70 or more, and 500 or less, 300 or less, or 250 or less. The viscosity index in the present specification refers to the viscosity index measured in accordance with JIS K2283:2000.

The lubricating oil composition can be used for any application, but may be preferably a lubricating oil composition (refrigerating machine oil) used together with a refrigerant. In this case, the lubricating oil composition (refrigerating machine oil) is used together with a refrigerant in a refrigeration machine. That is, one embodiment of the present invention is a working fluid composition containing the above lubricating oil composition (refrigerating machine oil) and a refrigerant.

Examples of the refrigerant include a saturated hydrofluorocarbon, an unsaturated hydrofluorocarbon, a hydrocarbon, a fluorine-containing ether, bis(trifluoromethyl) sulfide, trifluoroiodomethane, ammonia, and carbon dioxide. The refrigerant may be a single refrigerant of these refrigerants or a mixed refrigerant of two or more.

The saturated hydrofluorocarbon has at least a carbon atom and a fluorine atom. The saturated hydrofluorocarbon may be a saturated hydrofluorocarbon having preferably 1 to 3 carbon atoms, more preferably 1 to 2 carbon atoms. Examples of the saturated hydrofluorocarbon include difluoromethane (R32), trifluoromethane (R23), pentafluoroethane (R125), 1,1,2,2-tetrafluoroethane (R134), 1,1,1,2-tetrafluoroethane (R134a), 1,1,1-trifluoroethane (R143a), 1,1-difluoroethane (R152a), fluoroethane (R161), 1,1,1,2,3,3,3-heptafluoropropane (R227ea), 1,1,1,2,3,3-hexafluoropropane (R236ea), 1,1,1,3,3,3-hexafluoropropane (R236fa), 1,1,1,3,3-pentafluoropropane (R245fa), and 1,1,1,3,3-pentafluorobutane (R365mfc).

Examples of the preferred saturated hydrofluorocarbon include R32 alone; R23 alone; R134a alone; R125 alone; a mixture of R134a/R32=60 to 80% by mass/40 to 20% by mass; a mixture of R32/R125=40 to 70% by mass/60 to 30% by mass; a mixture of R125/R143a=40 to 60% by mass/60 to 40% by mass; a mixture of R134a/R32/R125=60% by mass/30% by mass/10% by mass; a mixture of R134a/R32/R125=40 to 70% by mass/15 to 35% by mass/5 to 40% by mass; a mixture of R125/R134a/R143a=35 to 55% by mass/1 to 15% by mass/40 to 60% by mass. More specifically, examples include a mixture of R134a/R32=70/30% by mass; a mixture of R32/R125=60/40% by mass; a mixture of R32/R125=50/50% by mass (R410A); a mixture of R32/R125=45/55% by mass (R410B); a mixture of R125/R143a=50/50% by mass (R507C); a mixture of R32/R125/R134a=30/10/60% by mass; a mixture of R32/R125/R134a=23/25/52% by mass (R407C); a mixture of R32/R125/R134a=25/15/60% by mass (R407E); a mixture of R125/R134a/R143a=44/4/52% by mass (R404A).

The saturated hydrofluorocarbon may further have a chlorine atom, and may be trichlorofluoromethane (R11), dichlorodifluoromethane (R12), chlorodifluoromethane (R22), or 2,2-dichloro-1,1,1-trifluoroethane (R123).

The unsaturated hydrofluorocarbon has at least a carbon atom, a hydrogen atom, and a fluorine atom, and one carbon-carbon unsaturated bond. The number of carbon atoms of the unsaturated hydrofluorocarbon may be 2 to 3, and the fluorine number may be 1 to 5. The unsaturated hydrofluorocarbon is preferably a fluoropropene, more preferably a fluoropropene having 3 to 5 fluorine atoms. The fluoropropene may be at least one selected from the group consisting of 1,2,3,3,3-pentafluoropropene (HFO-1225ye), 1,3,3,3-tetrafluoropropene (HFO-1234ze), 2,3,3,3-tetrafluoropropene (HFO-1234yf), 1,2,3,3-tetrafluoropropene (HFO-1234ye), and 3,3,3-trifluoropropene (HFO-1243zf), and is preferably 2,3,3,3-tetrafluoropropene (HFO-1234yf).

The unsaturated hydrofluorocarbon may be a fluoroethylene, preferably a fluoroethylene having 1 to 3 fluorine atoms, and more preferably a fluoroethylene having 2 to 3 fluorine atoms. Examples of the fluoroethylene include monofluoroethylene (HFO-1141), difluoroethylene (HFO-1132), and trifluoroethylene (HFO-1123).

The unsaturated fluorocarbon may further has a chlorine atom, and may be 1-chloro-2,3,3,3-tetrafluoropropene (HCFO-1224 yd). The 1-chloro-2,3,3,3-tetrafluoropropene (HCFO-1224 yd) may be cis-1-chloro-2,3,3,3-tetrafluoropropene (HCFO-1224 yd (Z)), trans-1-chloro-2,3,3,3-tetrafluoropropene (HCFO-1224 yd (E)), or a mixture thereof.

The hydrocarbon may be preferably a hydrocarbon having 1 to 5 carbon atoms, more preferably a hydrocarbon having 2 to 4 carbon atoms. Examples of the hydrocarbon include methane, ethylene, ethane, propylene, propane ($R^2$90), cyclopropane, n-butane, isobutane, cyclobutane, methylcyclopropane, 2-methylbutane, and n-pentane. The hydrocarbon may be preferably at least one selected from the group consisting of propane, n-butane, isobutane, and 2-methylbutane.

In one embodiment, the refrigerant may be a refrigerant represented by the following formula (X):

$$C_aF_bR_c \quad (X)$$

wherein R represents Cl, I, or H, a represents an integer of 1 to 6, b represents an integer of 0 to 12, and c represents an integer of 0 to 11. When a is an integer of 2 or more, the refrigerant represented by formula (X) may have a carbon-carbon unsaturated bond. When c is an integer of 2 or more, the multiple R's may be the same as or different from each other.

For example, in the above formula (X), when R is H, a is an integer of 1 to 6, b is an integer of 1 to 12, and c is an integer of 0 to 11 satisfying 2a+2−b, the refrigerant is a saturated hydrofluorocarbon having no chlorine or iodine atom.

The refrigerant may be represented by the above formula (X) and may have at least one of a chlorine atom, an iodine atom, and a carbon-carbon double bond. The refrigerant having a chlorine atom may be a saturated hydrofluorocarbon having a chlorine atom or an unsaturated hydrofluorocarbon having a chlorine atom, and specific examples can be selected from the above-mentioned examples. The refrigerant having a iodine atom may be an iodofluoromethane, specifically trifluoroiodomethane or the like. The refrigerant having a carbon-carbon double bond may be a fluoroethylene having 1 to 3 fluorine atoms, a fluoropropene having 1 to 5 fluorine atoms, a fluorobutene having 1 to 7 fluorine atoms, a fluoropentene having 1 to 9 fluorine atoms, a fluorohexene having 1 to 11 fluorine atoms, a fluorocyclobutene having 1 to 5 fluorine atoms, a fluorocyclopentene having 1 to 7 fluorine atoms, or a fluorocyclohexene having 1 to 9 fluorine atoms, and specific examples can be selected from the above-mentioned unsaturated hydrofluorocarbon refrigerants.

As described above, the refrigerating machine oil can be used together with a halogenated hydrocarbon refrigerants such as a hydrofluorocarbon having a chlorine atom, an unsaturated hydrofluorocarbon, and trifluoroiodomethane. The inventors have found that a refrigerating machine oil containing an orthophosphoric acid ester tend to generate acidic components due to the degradation of the orthophosphoric acid ester itself when exposed to moisture, air, or high heat, and catalytically degrade the refrigerant or refrigerating machine oil, promoting the consumption of an additional additive. In contrast, by using the phosphorus compound P according to this embodiment, it is possible to provide a lubricating oil composition that has excellent stability (resistance) against moisture, air, and high heat in the presence of the halogenated hydrocarbon refrigerant.

The content of the lubricating oil composition (refrigerating machine oil) in the working fluid composition may be 1 part by mass or more, or 2 parts by mass or more, and 500 parts by mass or less, or 400 parts by mass or less, with respect to 100 parts by mass of the refrigerant.

Examples

Hereinafter, the present invention will be described in more detail based on examples, but the present invention is not limited to these examples.

As the phosphorus compound P, phosphorus compounds 1 to 8 shown in Table 1 (phosphorus compounds in which $R^1$ and $R^2$ in the formula (1) are methyl groups) were used. The proportions (% by mole) of the phosphorus compound P0 wherein n is 0, the phosphorus compound P1 wherein n is 1, the phosphorus compound P2 wherein n is 2, and the phosphorus compound P3 wherein n is 3 in the phosphorus compound P were calculated based on the peak area percentages obtained by gas chromatography (carrier gas: helium, detector: FID, 300° C., column: Ultra Alloy 1HT, 150° C. to 300° C., temperature rise rate: 5° C./min, injection temperature: 300° C., split ratio: 1:100), assuming that the molecular weights of each component are the same and impurities are minimal, with % by area≈% by mass=% by mole. Additionally, the proportions can also be calculated from the integral values of the peaks attributed to each of the phosphorus compounds P0 to P3 observed around −17 ppm to −15 ppm (% by integral value=% by mole) by a $^{31}$P-NMR analysis (solvent: deuterated chloroform, pulse width: 30°, waiting time: 5 seconds, measurement method: 1H inverse gated decoupling method, chemical shift standard: phosphoric acid).

The proportions of the m-methylphenyl group (m-), p-methylphenyl group (p-), and o-methylphenyl group (o-) in the phosphorus compound P were calculated from the integral values of the peaks attributed to the carbon of the methyl group constituting the methylphenyl group observed around 20 ppm to 22 ppm (proportion of integral values=molar proportion) by a $^{13}$C-NMR analysis (solvent: deuterated chloroform, pulse width: 30°, waiting time: 10 seconds, measurement method: 1H inverse gated decoupling method, chemical shift standard: deuterated chloroform). Additionally, the identification and quantification of the phosphorus compound P can also be performed from the peaks at 10 to 32 ppm and 110 to 160 ppm (% by integral value=% by mole).

The kinematic viscosity at 40° C., acid value, flash point (COC), and chlorine content of the phosphorus compound P were measured by the following methods:

Kinematic viscosity at 40° C.: JIS K2283:2000

Acid value: JIS C2101:1999

Flash point (COC): JIS K2265-4:2007

Chlorine content: JPI-5S-64-2002 (2017 Supplement) "Petroleum Products—Test Method for Chlorine Content—Micro Coulometric Titration Method"

(Evaluation of Hydrolytic Stability)

In an air atmosphere, 75 g of one of the phosphorus compounds 1 to 8 shown in Table 1, 25 g of water, and a copper plate (5.1×1.3×0.2 cm) were placed in a 200 mL pressure-resistant bottle, sealed tightly, and heated at 93° C. for 144 hours while rotating the pressure-resistant bottle at 5 rpm. The acid values of the separated oil layer and water layer in the pressure-resistant bottle after heating were measured by the method described in JIS C2101:1999. The results are shown in Table 1.

TABLE 1

| | | Example | | | | | | | Comp. Example |
|---|---|---|---|---|---|---|---|---|---|
| | | 1-1 | 1-2 | 1-3 | 1-4 | 1-5 | 1-6 | 1-7 | 1-1 |
| Type of Phosphorus compound P | | 1 | 2 | 3 | 4 | 5 | 6 | 7 | 8 |
| Composition of phosphorus compound P | | | | | | | | | |
| Phosphorus compound P0 | % by mole | 28.9 | 29.4 | 26.2 | 22.1 | 33.7 | 23.7 | 34.8 | 14.9 |

TABLE 1-continued

| | | Example | | | | | | | Comp. Example |
|---|---|---|---|---|---|---|---|---|---|
| | | 1-1 | 1-2 | 1-3 | 1-4 | 1-5 | 1-6 | 1-7 | 1-1 |
| Phosphorus compound P1 | | 44.8 | 44.3 | 42.3 | 43.3 | 43.4 | 44.4 | 44.2 | 39.8 |
| Phosphorus compound P2 | | 22.7 | 22.4 | 26.0 | 28.3 | 20.2 | 26.9 | 18.4 | 35.2 |
| Phosphorus compound P3 | | 3.6 | 3.8 | 5.4 | 6.2 | 2.8 | 5.1 | 2.5 | 10.1 |
| P0 + P1 | | 73.7 | 73.8 | 68.5 | 65.4 | 77.1 | 68.0 | 79.1 | 54.7 |
| P1 + P2 | | 67.5 | 66.7 | 68.3 | 71.7 | 63.6 | 71.3 | 62.6 | 74.9 |
| P2 + P3 | | 26.3 | 26.2 | 31.5 | 34.6 | 23.0 | 32.0 | 20.9 | 45.3 |
| P0 + P1 + P2 | | 96.4 | 96.2 | 94.6 | 93.8 | 97.2 | 94.9 | 97.5 | 89.9 |
| P1 + P2 + P3 | | 71.1 | 70.6 | 73.8 | 77.9 | 66.4 | 76.3 | 65.2 | 85.1 |
| P0/P3 | Molar ratio | 8.0 | 7.7 | 4.8 | 3.6 | 12.0 | 4.7 | 13.8 | 1.5 |
| P1/P2 | | 2.0 | 2.0 | 1.6 | 1.5 | 2.1 | 1.6 | 2.4 | 1.1 |
| P1/P0 | | 1.5 | 1.5 | 1.6 | 2.0 | 1.3 | 1.9 | 1.3 | 2.7 |
| P2/P0 | | 0.8 | 0.8 | 1.0 | 1.3 | 0.6 | 1.1 | 0.5 | 2.4 |
| (P1 + P2)/P0 | | 2.3 | 2.3 | 2.6 | 3.2 | 1.9 | 3.0 | 1.8 | 5.0 |
| P3/P0 | | 0.13 | 0.13 | 0.21 | 0.28 | 0.08 | 0.21 | 0.07 | 0.68 |
| P1/P3 | | 12.4 | 11.6 | 7.8 | 7.0 | 15.4 | 8.7 | 17.5 | 3.9 |
| P2/P3 | | 6.3 | 5.9 | 4.8 | 4.6 | 7.2 | 5.3 | 7.3 | 3.5 |
| (P0 + P1)/(P2 + P3) | | 2.8 | 2.8 | 2.2 | 1.9 | 3.3 | 2.1 | 3.8 | 1.2 |
| (P1 + P2)/P3 | | 18.7 | 17.5 | 12.6 | 11.5 | 22.6 | 14.0 | 24.8 | 7.4 |
| Proportion of alkylphenyl group | | | | | | | | | |
| m-Methylphenyl group | % by mole | 67 | 61 | 59 | 61 | 62 | 63 | 66 | 54 |
| p-Methylpheny1 group | | 33 | 39 | 41 | 39 | 38 | 37 | 34 | 46 |
| o-Methylphenyl group | | <0.1 | <0.1 | <0.1 | <0.1 | <0.1 | <0.1 | <0.1 | <0.1 |
| (m-)/(p-) | Molar ratio | 2.0 | 1.6 | 1.4 | 1.6 | 1.6 | 1.7 | 1.9 | 1.2 |
| Kinematic Viscosity at 40° C. | $mm^2/s$ | 21.67 | 21.76 | 21.84 | 21.57 | 21.36 | 21.4 | 21.67 | 21.84 |
| Acid Value | mgKOH/g | 0.00 | 0.01 | 0.02 | 0.00 | 0.03 | 0.00 | 0.05 | 0.00 |
| Flash Point (COC) | ° C. | 272 | 272 | 274 | 270 | 266 | 260 | 272 | 273 |
| Chlorine Content | ppm by mass | 23 | <10 | <10 | 10 | 80 | 87 | 190 | <10 |
| Evaluation of hydrolytic stability | | | | | | | | | |
| Acid value of oil layer | mgKOH/g | 0.00 | 0.01 | 0.03 | 0.03 | 0.01 | 0.01 | 0.03 | 0.11 |
| Acid value of water layer | | 2.4 | 2.8 | 3.4 | 10.2 | 3.5 | 5.0 | 7.1 | 16.6 |

(Evaluation of Stability of Lubricating Oil Composition in the Presence of Refrigerant 1)

Lubricating oil compositions of Examples 2-1 to 2-3 and Comparative Example 2-1 each containing 99% by mass of lubricating base oil 1 (naphthenic mineral oil, kinematic viscosity at 40° C.: 56 $mm^2/s$, initial acid value: <0.01 mgKOH/g), 0.8% by mass of one of the phosphorus compounds 1, 4, 6, and 8 shown in Table 2, and 0.2% by mass of additional additives (phenolic antioxidant and sulfur-phosphorus extreme pressure agent) were prepared. The stability of these lubricating oil compositions in the presence of a refrigerant was evaluated. Specifically, 30 g of the lubricating oil composition adjusted to a moisture content of <10 ppm, 30 g of refrigerant (R22), and a catalyst (copper, iron, aluminum, each 0.6 mmϕ×50 mm) were placed in an autoclave and heated at 200° C. for 336 hours. The color (ASTM D156), residual rate of the phosphorus compound P, acid value, and amount of impurities of the lubricating oil composition after heating were measured. The results are shown in Table 2. The residual rate of the phosphorus compound P was calculated by quantifying the content C0 (mass) of the phosphorus compound P in the lubricating oil composition before the autoclave test and the content C1 (mass) of the phosphorus compound P in the lubricating oil composition after the autoclave test by HPLC or GC, using the following formula:

$$\text{Residual rate of phosphorus compound } P \text{ (\% by mass)} = C1/C0 \times 100$$

The amount of impurities (mg/100 g) was calculated by filtering the lubricating oil composition after heating through a cellulose filter with a pore size of 0.3 μm, washing the filtrate and filter thoroughly with hexane to remove hexane-soluble components, and drying the obtained filtrate to determine the weight of the impurities, which was then converted to the amount per 100 g of the lubricating oil composition.

TABLE 2

| | | Example 2-1 | Example 2-2 | Example 2-3 | Comp. Example 2-1 |
|---|---|---|---|---|---|
| Type of phosphorus compound P | | 1 | 4 | 6 | 8 |
| Composition of lubricating oil composition (% by mass) | Lubricating base oil 1 | 99.0 | 99.0 | 99.0 | 99.0 |
| | Phosphorus compound P | 0.8 | 0.8 | 0.8 | 0.8 |
| | Additional additives | 0.2 | 0.2 | 0.2 | 0.2 |
| Evaluation of stability | Residual rate of phosphorus compound P (% by mass) | 95 | 80 | 85 | 65 |
| | Color | L0.5 | L1.5 | 1.1.0 | L2.0 |
| | Acid value (mgKOH/g) | <0.01 | 0.03 | 0.02 | 0.05 |
| | Amount of impurities (mg/100 g) | <1.0 | 4.3 | 3.1 | 6.4 |

The results in Table 2 show that, although the difference in the increase of the acid value between the examples and the comparative example is small due to the evaluation being conducted under conditions where the lubricating base oil 1 is the mineral oil and there is no moisture, differences in the trends of degradation were observed between the examples and the comparative example in terms of the residual rate of the phosphorus compound P, color, and amount of impurities.

(Evaluation of Stability of Lubricating Oil Composition in the Presence of Refrigerant 2)

Lubricating oil compositions of Examples 3-1 to 3-7 and Comparative Example 3-1 each containing 97.7% by mass of lubricating base oil 2 ester (polyol of a mixed alcohol of pentaerythritol/dipentaerythritol and a mixed fatty acid of 2-ethylhexanoic acid/3,5,5-trimethylhexanoic acid), 1% by mass of one of the phosphorus compounds 1 to 8 shown in Table 3, and 1.3% by mass of additional additives (phenolic antioxidant and glycidyl ester acid scavenger) were prepared. The stability of these lubricating oil compositions in the presence of refrigerant, moisture, and air was evaluated. Specifically, 30 g of the lubricating oil composition adjusted to a moisture content of 500 ppm by mass, 30 g of refrigerant (HFO-1234yf), and a catalyst (copper, iron, aluminum, each 0.6 mmϕ×50 mm) were placed in an autoclave, and the amount of air in the refrigerant was adjusted to 1000 ppm by mass, followed by heating at 175° C. for 336 hours. The acid value (JIS C2101:1999), color (ASTM D156), and residual rates of each additive in the lubricating oil composition after heating were measured. The results are shown in Table 3. The residual rate of each additive was calculated by quantifying the content C0 (mass) of each additive in the lubricating oil composition before heating and the content C1 (mass) of each additive in the lubricating oil composition after heating by HPLC or GC, using the following formula:

$$\text{Residual rate of additive (\% by mass)} = C1/C0 \times 100$$

TABLE 3

| | | Example 3-1 | 3-2 | 3-3 | 3-4 | 3-5 | 3-6 | 3-7 | Comp. Example 3-1 |
|---|---|---|---|---|---|---|---|---|---|
| Type of Phosphorus compound P | | 1 | 2 | 3 | 4 | 5 | 6 | 7 | 8 |
| Composition of lubricating oil composition (% by mass) | Lubricating base oil 2 | 97.7 | 97.7 | 97.7 | 97.7 | 97.7 | 97.7 | 97.7 | 97.7 |
| | Phosphorus compound P | 1.0 | 1.0 | 1.0 | 1.0 | 1.0 | 1.0 | 1.0 | 1.0 |
| | Additional additives | 1.3 | 1.3 | 1.3 | 1.3 | 1.3 | 1.3 | 1.3 | 1.3 |
| Evaluation of stability | Acid value (mgKOH/g) | <0.1 | <0.1 | <0.1 | 0.3 | <0.1 | 0.12 | 0.15 | >0.5 |
| | Color | L1.5 | L1.5 | L1.5 | L2.0 | L1.5 | L1.5 | L1.5 | L2.5 |
| | Residual rate of phosphorus compound P (% by mass) | 100 | 100 | 99 | 85 | 99 | 92 | 90 | 70 |
| | Residual rates of acid scavenger (% by mass) | 50 | 50 | 50 | <10 | 50 | 20 | 30 | <10 |

The results in Table 3 show the evaluation results under severe conditions where moisture and air are mixed, and differences in the trends of degradation were observed between the examples and the comparative examples in terms of acid value, residual rate of the phosphorus compound P, and residual rate of the acid scavenger.

(Evaluation of Stability of Lubricating Oil Composition in the Presence of Refrigerant 3)

Lubricating oil compositions of Example 4-1, Comparative Example 4-1, and Comparative Example 4-2 each containing 96.95% by mass of lubricating base oil 3 (polyol ester of pentaerythritol and a mixed fatty acid of 2-ethylhexanoic acid/3,5,5-trimethylhexanoic acid), 1.0% by mass of the above phosphorus compound 1, phosphorus compound P0 as tri(m-methylphenyl) phosphate (reagent: purity 99% or more), or phosphorus compound P3 as tri(p-methylphenyl) phosphate (reagent: purity 99% or more), and 2.05% by mass of additional additives (phenolic antioxidant and glycidyl ester acid scavenger) were prepared. The stability of these lubricating oil compositions in the presence of refrigerant and moisture was evaluated. Specifically, 30 g of the lubricating oil composition adjusted to a moisture content of 1000 ppm by mass, 30 g of refrigerant (HFO-1234yf), and a catalyst (copper, iron, aluminum, each 0.6 mmϕ×50 mm) were placed in an autoclave under conditions without air and heated at 175° C. for 168 hours. The acid value (JIS C2101:1999), color (ASTM D156), and residual rates of each additive in the lubricating oil composition after heating were measured. The results are shown in Table 4. The residual rates of each additive were calculated in the same manner as described above.

TABLE 4

| | | Example | Comp. Example | |
|---|---|---|---|---|
| | | 4-1 | 4-1 | 4-2 |
| Composition of lubricating oil composition (% y mass) | Lubricating base oil 3 | 96.95 | 96.95 | 96.95 |
| | Phosphorus compound P (Phosphorus compound 1) | 1.0 | — | — |
| | Phosphorus compound P0 | — | 1.0 | — |
| | Phosphorus compound P3 | — | — | 1.0 |
| | Additional additives | 2.05 | 2.05 | 2.05 |
| Evaluation of stability | Acid value (mgKOH/g) | 0.01 | 0.01 | 0.01 |
| | Color | L0.5 | L0.5 | L0.5 |
| | Residual rate of phosphorus compound P (% by mass) | 98 | 96 | 98 |
| | Residual rate of antioxidant (% by mass) | 100 | 97 | 97 |
| | Residual rate of acid scavenger (% by mass) | 70 | 60 | 40 |

The results of this evaluation are under relatively mild test conditions without air, and since the content of the antioxidant and acid scavenger was sufficient, the acid value was suppressed to 0.01 mgKOH/g and the color to L0.5 in all lubricating oil compositions. However, differences in the trends of degradation were observed between the examples and the comparative examples in terms of the residual rate of the acid scavenger. From these results, it is considered that the lubricating oil composition using the phosphorus compound 1, which is a mixture of the phosphorus compound P0, phosphorus compound P1, phosphorus compound P2, and phosphorus compound P3, can suppress the progress of degradation in the presence of unsaturated fluorocarbon refrigerants and improve stability (resistance) compared to using the phosphorus compound P0 alone or P3 alone.

The invention claimed is:

1. A working fluid composition comprising:

the lubricating oil composition; and a refrigerant; wherein the lubricating oil composition comprises:

a lubricating base oil; and a phosphorus compound P represented by the following formula (1):

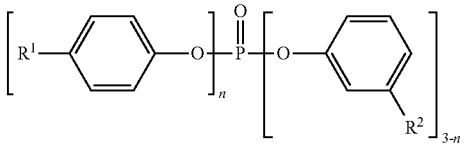

(1)

wherein $R^1$ and $R^2$ each independently represent an alkyl group having 1 to 3 carbon atoms, and n represents an integer of 0 to 3, wherein the phosphorus compound P comprises a phosphorus compound P0 wherein n is 0, a phosphorus compound P1 wherein n is 1, a phosphorus compound P2 where n is 2, and a phosphorus compound P3 wherein n is 3, and a total proportion of the phosphorus compound P0 and the phosphorus compound P1 in the phosphorus compound P is 60% by mole or more.

2. The working fluid composition according to claim 1, wherein the refrigerant is represented by the following formula (X):

$$C_aF_bR_c \quad (X)$$

wherein

R represents Cl, I, or H, a represents an integer of 1 to 6, b represents an integer of 1 to 12, and c represents an integer of 0 to 11 satisfying 2a+2−b.

3. The working fluid composition according to claim 1, wherein the refrigerant has at least one of a chlorine atom, an iodine atom, and a carbon-carbon double bond.

4. The working fluid composition according to claim 1, wherein a total proportion of the phosphorus compound P1 and the phosphorus compound P2 in the phosphorus compound P is 50% by mole or more.

5. The working fluid composition according to claim 1, wherein a total proportion of the phosphorus compound P0, the phosphorus compound P1, and the phosphorus compound P2 in the phosphorus compound P is 92% by mole or more, and a total proportion of the phosphorus compound P1, the phosphorus compound P2, and the phosphorus compound P3 in the phosphorus compound P is 82% by mole or less.

* * * * *